US006421034B1

(12) United States Patent
Mihara

(10) Patent No.: US 6,421,034 B1
(45) Date of Patent: Jul. 16, 2002

(54) EL DRIVER CIRCUIT

(75) Inventor: Masaaki Mihara, Chiba (JP)

(73) Assignee: STMicroelectronics K.K. (JP)

( * ) Notice: Subject to any disclaimer, the term of this patent is extended or adjusted under 35 U.S.C. 154(b) by 0 days.

(21) Appl. No.: 09/373,114

(22) Filed: Aug. 12, 1999

(30) Foreign Application Priority Data

Dec. 28, 1998 (JP) ..... 10-374545

(51) Int. Cl.[7] ..... G09G 3/30
(52) U.S. Cl. ..... 345/76; 315/169.3
(58) Field of Search ..... 340/76, 77, 78, 340/79, 80, 60; 315/169.3, 224

(56) References Cited

U.S. PATENT DOCUMENTS 4,347,558 A * 8/1982 Kalinsky
4,633,141 A * 12/1986 Weber ..... 315/169.3
4,982,314 A * 1/1991 Miki ..... 315/169.3
5,027,040 A * 6/1991 Ikeda et al. ..... 315/169.3
5,440,208 A * 8/1995 Uskali et al. ..... 315/169.3
5,517,089 A * 5/1996 Ravid ..... 315/169.3
5,705,895 A * 1/1998 Mihara ..... 315/224
5,838,113 A * 11/1998 Mihara ..... 315/169.3

* cited by examiner

*Primary Examiner*—Regina Liang
(74) *Attorney, Agent, or Firm*—Dave V. Carlson; Lisa K. Jorgenson

(57) ABSTRACT

A serial resonant circuit, formed by EL panel ($C_{EL}$) and coil ($L_1$), is connected to a push-pull driver through a positive feedback path to form an oscillator circuit. The EL panel is driven by a sinusoidal driving signal to emit light. The voltage level of the EL panel driving signal is adjusted corresponding to the change in the capacitance of the EL panel so that the luminous brightness of the EL panel can be maintained on a constant level.

27 Claims, 4 Drawing Sheets

EL DRIVER CIRCUIT

TECHNICAL FIELD

The present invention pertains to a driver circuit that can drive an electroluminescent (referred to as "EL" hereinafter) panel to light a panel. More specifically, the present invention pertains to an EL driver circuit that can automatically detect the drop in the luminous brightness caused by changes in the EL panel over time and is able to adjust the driving voltage of the EL panel to recover the desired luminous brightness.

BACKGROUND OF THE INVENTION

The present inventors have invented an EL driver circuit which uses a parallel resonant circuit formed by an autotransformer and an EL panel to drive and light the EL panel. The details are described in Japanese Kokai Patent Application No. Hei 8[1996]-168262.

EL driver circuits generally use a parallel resonant circuit that is driven with a sinusoidal ac driving signal, which causes the EL panel to emit light at a high efficiency. However, in order to obtain the desired effect, the wire size of the autotransformer must be enlarged and a large core must be used. Consequently, the device cannot be miniaturized, leading to a high cost.

Although an EL panel can effectively form a capacitor, it is known that the capacitance will drop over time. In this case, since the EL panel forms a parallel resonant circuit together with the autotransformer, the resonant frequency of the resonant circuit will rise automatically as the capacitance of the EL panel drops. As a result, the number of times that the EL panel is lit per unit time is increased. Consequently, the brightness is recovered to a certain degree. However, when the capacitance of the EL panel decreases, the current level of the driving signal of the EL panel drops, and the luminous brightness becomes low. Therefore, the luminous brightness of the EL panel cannot be fully recovered by simply increasing the number of times that the panel is lit per unit time as a result of increase in the resonant frequency.

SUMMARY OF THE INVENTION

An EL driver circuit having high luminous efficiency, small size, and low cost is provided. The EL driver circuit is configured to automatically detect changes in the EL panel occurring over time and to recover the luminous brightness level. In addition, the EL driver circuit can detect the decrease in the capacitance of the EL panel and is able to raise the voltage level of the driving signal of the EL panel.

The EL driver circuit includes a push-pull driver, which has an output end and an input end and is connected between a supply voltage and a first fixed voltage, an EL panel, which can effectively form a capacitor, and a coil which is connected in series to the EL panel; one end of the serial connection of the aforementioned EL panel and coil is connected to the output end of the aforementioned push-pull driver, while the other end is connected to the input end of the aforementioned push-pull driver in a positive feedback manner.

In the EL driver circuit of one embodiment of the invention, an EL panel and a coil are connected to each other in series to form a serial resonant circuit. The serial resonant circuit is connected to a push-pull driver through a positive feedback path, and the whole unit forms an oscillator circuit. When the serial resonant circuit comprising the EL panel and the coil is formed, the driving signal applied to the EL panel becomes an ac signal in the form of a sinusoidal wave free of noise. As a result, the EL panel can be lit at a high efficiency. Also, in this case, since the serial resonant circuit is formed by an EL panel and coil, the coil, especially, can be miniaturized compared with using the parallel resonant circuit described in Japanese Kokai Patent Application No. Hei 8[1996]-168262. Consequently, the entire device can be miniaturized and the cost can be lowered. In addition, since a signal in the form of an almost completely sinusoidal wave can be obtained as the driving signal, excellent luminous properties can be realized.

In accordance with another aspect of the invention, an EL driver circuit includes:

- a push-pull driver that is connected between a supply voltage and a first fixed voltage and is configured to output the aforementioned supply voltage in the form of a rectangular wave;
- a coil, which is connected to an EL panel that can effectively form a capacitor to constitute a resonant circuit, and which is connected in a loop formed by coupling the push-pull driver and the resonant circuit;
- an integrator circuit configured to receive and integrate the driving voltage of the EL panel;
- a driving voltage level detecting circuit configured to receive and detect the change in the level of the driving voltage of the EL panel based on the first reference voltage and the integrated voltage obtained by the integrator circuit;
- a supply voltage level adjusting circuit configured to adjust the level of the supply voltage supplied to the push-pull driver corresponding to the detection signal sent from the driving voltage level detecting circuit; and
- a variable voltage source that can supply an adjusted supply voltage to the push-pull driver corresponding to the adjustment signal.

In the EL driver circuit, the resonant circuit is formed by an EL panel and a coil, and the EL panel is driven and lit by a driving signal in the form of sinusoidal wave. In this case, the voltage level of the driving signal supplied to the resonant circuit can be adjusted, such as increased in response to the changes, especially a decrease, in the capacitance of the EL panel occurring over time. For example, when the capacitance of the EL panel decreases due to the changes occurring over time, the resonant frequency of the resonant circuit formed by the EL panel and the coil rises. As a result, the number of times that the EL panel is lit per unit time is increased. Consequently, the drop in the luminous brightness of the EL panel caused by the decrease in the capacitance of the EL panel can be compensated.

According to a further aspect of the invention, when the capacitance of the EL panel changes, the level of the voltage supplied to the push-pull driver can be adjusted in response to the change in the capacitance, and the voltage level of the signal used for driving the EL panel can be adjusted. For example, when the capacitance of the EL panel decreases, the voltage supplied to the push-pull driver is increased correspondingly. As a result, the voltage level of the ac driving signal in the form of a sinusoidal wave applied to the EL panel is increased. Consequently, the luminous brightness of the EL panel can be prevented from dropping.

In accordance with yet another aspect of the present invention, the resonant circuit comprising the coil and the EL panel is preferably a serial resonant circuit formed by connecting the EL panel to the coil in series. The adjusting mechanism used for adjusting the voltage level of the driving signal of the EL panel is not limited to the serial resonant circuit. For example, it is also possible to use the parallel resonant circuit formed by connecting the coil in parallel with the EL panel described in said Japanese Kokai Patent Application No. Hei 8[1996]-168262.

Consequently, the function of the EL driver circuit of the invention is not simply to increase the frequency of the driving signal in an automatic manner corresponding to the capacitance of the EL panel. Instead, the EL driver circuit can maintain the luminous level on an appropriate level by actively adjusting the voltage level of the driving signal of the EL panel corresponding to the change in the capacitance of the EL panel. Therefore, the EL driver circuit can prevent degradation in the luminous property caused by the deterioration of the EL panel itself, and the service life of the EL panel can be prolonged.

DETAILED DESCRIPTION OF THE INVENTION

Figure 1:
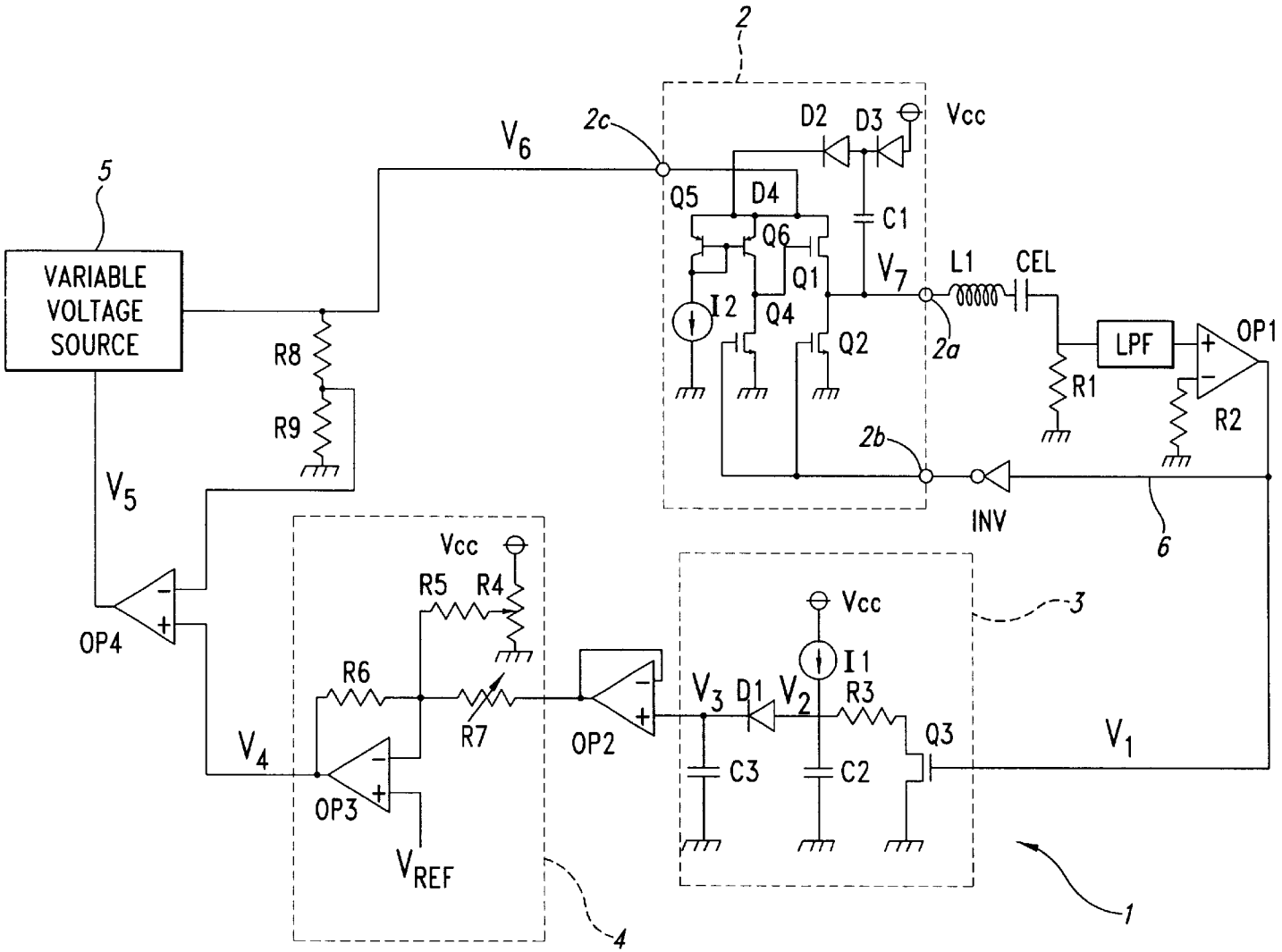
FIG. 1 is a schematic diagram illustrating the overall configuration of an EL driver circuit formed in accordance with the invention.

FIG. 1 is a schematic diagram illustrating the overall configuration of an EL driver circuit 1. As shown in FIG. 1, EL driver circuit 1 has a capacitor $C_{EL}$ corresponding to the EL panel and a coil $L_1$, which is connected in series to the capacitor. A serial resonant circuit is formed by capacitor $C_{EL}$ and coil $L_1$. Consequently, the resonant circuit has a resonant frequency of $f=1/(2\pi\cdot SQRT(L_1C_{EL}))$. SQRT( ) is a symbol indicating the square root of the variable inside the brackets ( ).

In the example shown in FIG. 1, the end of coil $L_1$ on the opposite side with respect to the end connected to EL panel $C_{EL}$ is connected to an output end 2*a* of a push-pull driver 2. Said push-pull driver 2 has a supply voltage input end 2*c*, which receives variable supply voltage V6 to be described later, and a feedback signal input end 2*b* that receives a feedback signal from the resonant circuit. The push-pull driver 2 forms a closed loop through a positive feedback path 6 together with the LC serial resonant circuit comprising coil $L_1$ and EL panel $C_{EL}$. The entire loop basically forms an oscillator circuit.

The basic configuration of push-pull driver 2 is that it has a pair of transistors, a first transistor Q1 and a second transistor Q2, connected in a push-pull state between the supply voltage and the ground voltage. A pair of N-channel MOSFETs are used as the transistors Q1 and Q2. The drain of the first transistor Q1 is connected to supply voltage V6, and its source is connected to the drain of the second transistor Q2. The source of the second transistor Q2 is connected to the ground. The common connection node of the first and second transistors is connected to output end 2*a* of push-pull driver 2. Also, supply voltage V6 is applied to the gate of the first transistor Q1 through diode D4 and a current mirror formed by the third and fourth transistors Q5 and Q6, which are bipolar transistors, after the voltage level is lowered by as much as the voltage drop across the aforementioned diode and the current mirror. However, during operation the bootstrap voltage Vcc−1.2 V of capacitor C1 is added to V6−0.6 V and is applied to the transistor Q1 gate. On the other hand, the gate of the second transistor Q2 is connected to a positive feedback signal input end 2*b* of push-pull driver 2.

In the circuit shown in FIG. 1, the collector of the third transistor Q5 is connected to ground through a current source I2. The collector of the fourth transistor Q6 is connected to the gate of the first transistor Q1 and to ground through the fifth transistor Q4, which is a MOSFET. The gate of the fifth transistor Q4 is connected to ground through positive feedback signal input end 2*b*. Also, a pair of diodes D2 and D3 are connected in series to each other between the fixed power voltage Vcc and the common emitter connection node of the current mirror comprising the third and fourth transistors. Capacitor C1 is connected between the output end 2*a* of the push-pull driver 2 and a node between the aforementioned diodes.

The push-pull driver 2 receives the supply voltage V6, a dc voltage, at supply voltage input end 2*c*. The supply voltage V6 is turned on and off periodically by the push-pull operation of the first and second transistors. As a result, the supply voltage V6 is pulsed to generate a pulse array with the voltage level of the supply voltage V6 at output end 2*a*. In this case, the period of the pulse is controlled by the period of the sinusoidal wave which is the driving signal of EL panel $C_{EL}$ input from positive feedback signal input end 2*b*. Consequently, the push-pull driver 2 is configured to pulse supply voltage V6, a dc voltage, based on the period of the sinusoidal driving signal of EL panel $C_{EL}$. The specific configuration shown in FIG. 1 is not the only choice.

As far as the configuration of push-pull driver 2 shown in FIG. 1 is concerned, the constituent elements other than the first and second transistors Q1 and Q2 become necessary because N-channel MOSFETs are used as the first and second transistors Q1 and Q2, which are the basic configuration. The configuration of push-pull driver 2 is not limited to the specific one shown in FIG. 1. For example, it is also possible to use the modified examples shown in FIGS. 3*a* and 3*b* as push-pull driver 2. Push-pull driver 2' shown in FIG. 3 a has a first transistor Q11 and a second transistor Q12 as the basic configuration. In this case, the first transistor Q11 is a P-channel MOSFET, while the second transistor Q12 is an N-channel MOSFET. Therefore, a so-called CMOS structure is formed by the first and second transistors. In this case, the drain of the first transistor Q11 is connected to supply voltage input end 2*c*, and the common connection node of the first and second transistors Q11 and Q12 is connected to output end 2*a*. Also, the gates of the first and second transistors Q11 and Q12 are connected to each other and to positive feedback signal input end 2b.

Figure 3A:
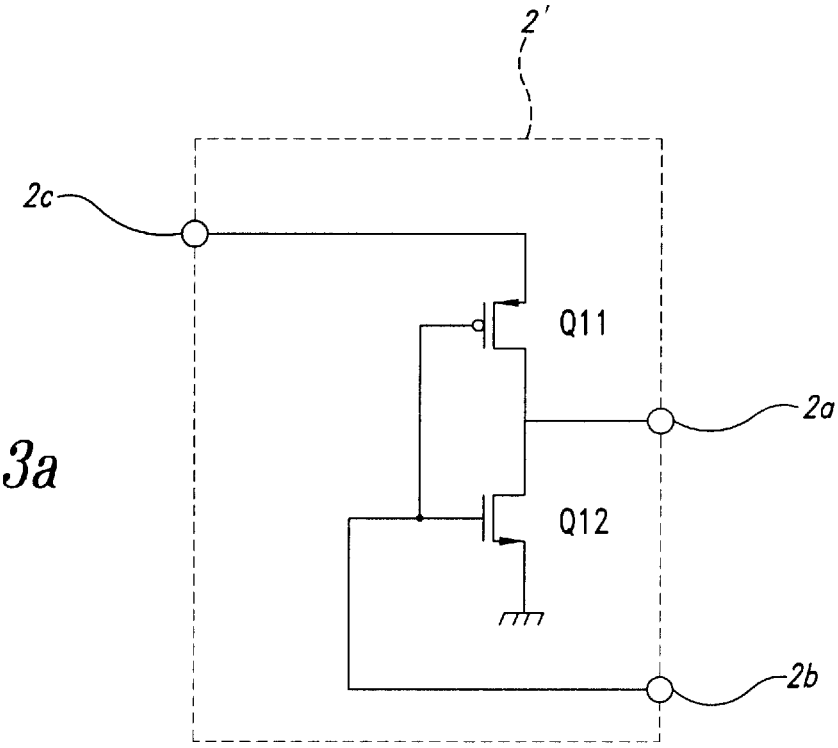
FIGS. 3*a* and 3*b* are schematic diagrams illustrating two modified examples of the push-pull driver shown in FIG. 1.
Figure 3B:
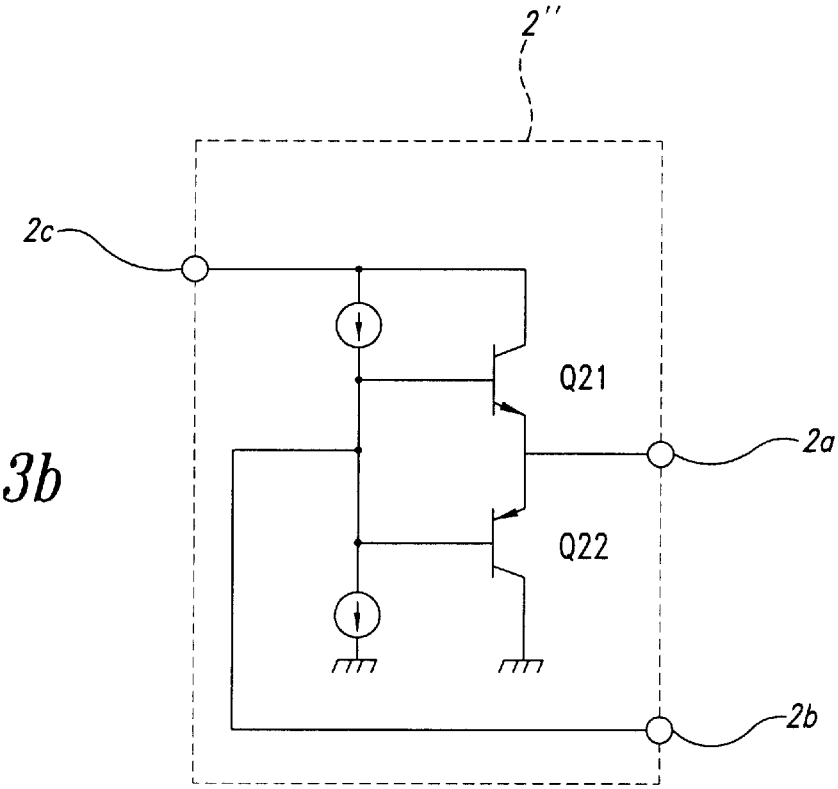

The push-pull driver 2" shown in FIG. 3*b* has a first transistor Q21 and a second transistor Q22, which are a pair of bipolar transistors. The first transistor Q21 is an NPN bipolar transistor, while the second transistor Q22 is a PNP bipolar transistor. The collector of the first transistor Q21 is connected to supply voltage input end 2*c* and to its base through current source I21. Its emitter is connected to the emitter of the second transistor Q22 and to output end 2*a* of the push-pull driver. Also, the base of the second transistor Q22 is connected to the base of the first transistor Q21 and to the ground through another current source 122. Its collector is also connected to the ground. The bases of the first and second transistors Q21 and Q22 are connected to each other and to the positive feedback signal input end 2*b*.

As can be seen from the examples shown in FIGS. 3*a* and 3*b*, the configuration of push-pull driver 2 is not limited to that shown in FIG. 1. Any type of push-pull driver, such as those shown in FIGS. 3*a* and 3*b*, can be used as long as it has the basic function of push-pull driver 2, that is, the function of pulsing supply voltage V6, a dc voltage, at the period of the driving signal used for driving EL panel $C_{EL}$.

As shown in FIG. 1, the opposite side of EL panel $C_{EL}$ with respect to the side connected to coil $L_1$ is connected to ground through resistor R1 and to the input end of lowpass filter LPF. Resistor R1 is used to fetch the sinusoidal driving signal used for driving EL panel $C_{EL}$. The driving signal is passed through lowpass filter LPF to eliminate the noise, that is, the high-frequency component. The output end of lowpass filter LPF is connected to the positive input end of op amp OP1 which forms a comparator. The negative input end of op amp OP1 is connected to ground through resistor R2. Consequently, the EL driving signal with the noise eliminated is input from the positive input end of op amp OP1 and compared with a prescribed voltage set at the negative input end. As a result, a pulse array is generated at the output end based on the period of the EL driving signal.

The output end of op amp OP1 is connected to positive feedback path 6. Positive feedback path 6 is connected to positive feedback input end 2*b* of push-pull driver 2. An inverter INV is set on positive feedback path 6. The inverter is used when it is necessary to control the phase so that the signal on positive feedback path 6 applies a positive feedback in the closed loop, which includes the LC resonant circuit. Since a positive feedback is applied to the LC resonant circuit by positive feedback path 6, the closed loop basically forms an oscillator circuit. The aforementioned configuration can ensure that the driving signal used for driving EL panel $C_{EL}$ has a sinusoidal waveform. Consequently, the luminous efficiency of EL panel $C_{EL}$ is improved, and the problems, such as flickering, will not occur.

The output end of op amp OP1 is connected to the input end of an integrator circuit 3. The input end of integrator circuit 3 is formed by the gate of transistor Q3, which is an N-channel MOSFET. The source of transistor Q3 is connected to ground, and its drain is connected to integration node V2 through resistor R3. Resistor R3 is used to control the current when capacitor C2 is discharged. Integration node V2 is connected to fixed power voltage Vcc through current source I1 and to ground through capacitor C2. Also, integration node V2 is connected to output end V3 of said integrator circuit 3 through diode D1, and the output end V3 is connected to ground through capacitor C3.

Consequently, an integration signal V2 is generated at the integration node by transistor Q3, current source I1, and capacitor C2 based on the pulse array sent from op amp OP1. The integration signal V2 is smoothed by a smoothing circuit formed by diode D1 and capacitor C3 to generate integration signal V3, which is a dc voltage.

The output end of integrator circuit 3 is connected to the positive input end of op amp OP2, which has its negative input end feedback connected to the output end and acts as an impedance transducer, to apply the smoothed integration signal. The output end of op amp 2 is connected to the input end of driving voltage level detecting circuit 4. The input end of driving voltage level detecting circuit 4 is connected to the negative input end of op amp OP3 through variable resistor R7. The positive input end of op amp OP3 is connected to a prescribed reference voltage $V_{REF}$ which is set in advance. Variable resistor R7 is used so that the gain of the correction amount can be set in a variable manner when the brightness of the EL panel drops. The negative input end of op amp OP3 is connected to the tap of resistor R4 through resistor R5 and to the output end of op amp OP3 through resistor R6. The output end of the op amp forms the output end of driving voltage signal level detecting circuit 4. Resistor R4 is used so that a prescribed voltage level can be set at its tap. On the other hand, variable resistor R7 is used to adjust the gain of op amp OP3.

The output end of driving voltage signal level detecting circuit 4 is connected to the positive input end of comparator OP4, which is an op amp. The detection signal V4 obtained by detecting the driving voltage signal level is supplied to the positive input end of this op amp. On the other hand, the negative input end of op amp OP4 is connected to a connection node between a pair of voltage dividing resistors R8 and R9 connected between the ground and a line for supplying variable supply voltage V6 to the push-pull driver. The output end of op amp OP4 is connected to the input end of variable voltage source 5. Together with resistors R8 and R9, comparator OP4 forms a feedback path of variable voltage source 5 for variable supply voltage V6 supplied to the output end of variable voltage source 5. The level of supply voltage V6 supplied from variable voltage source 5 is controlled based on the signal sent from driving voltage signal level detecting circuit 4. Any type of voltage source with the aforementioned function can be used as variable voltage source 5. In one embodiment, a dc/dc converter 5' shown in FIG. 4 is used.

Figure 4:
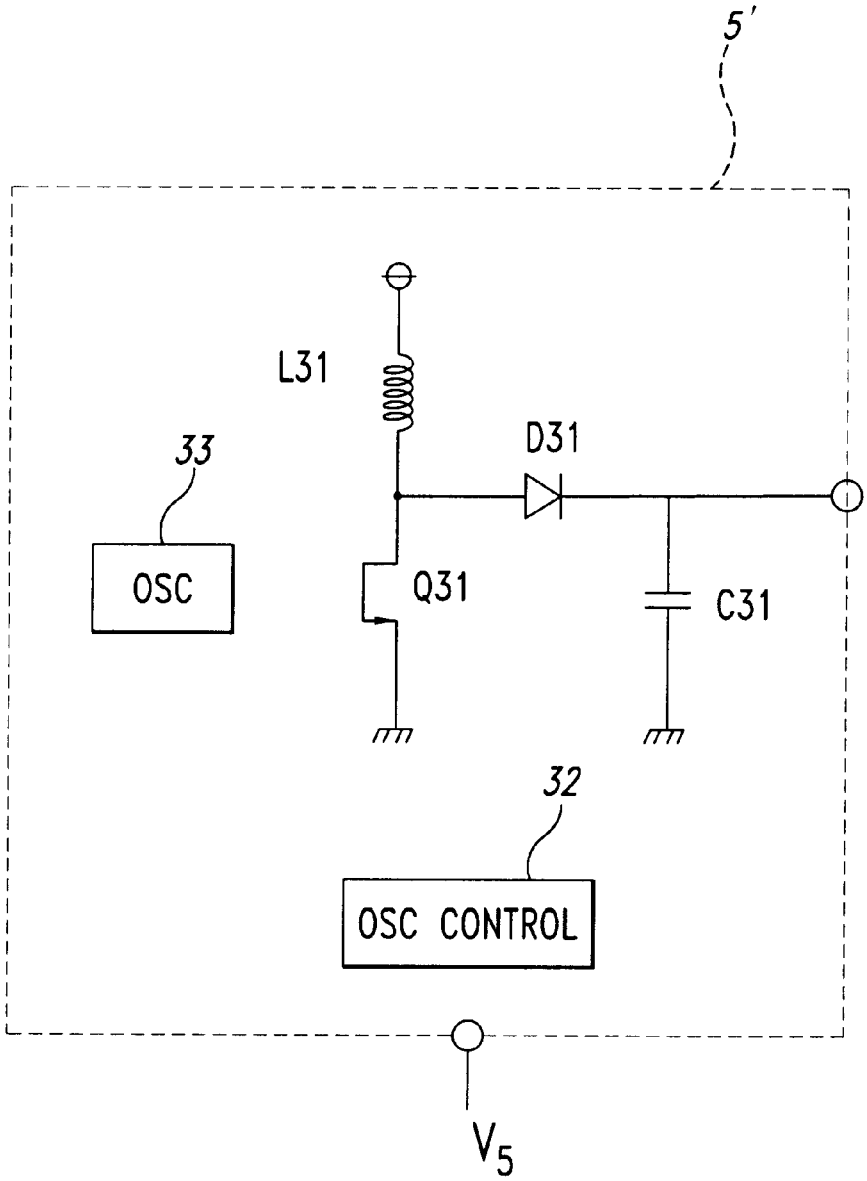
FIG. 4 is a schematic diagram illustrating an example of the variable voltage source shown in FIG. 1 formed by a dc/dc converter.

The dc/dc converter 5' shown in FIG. 4 has an OSC controller 32 to which adjustment signal V5 input from op amp OP4 is supplied, an oscillator OSC 33 to which the control signal from said OSC controller 32 is supplied, and an N-channel MOSFET Q31 which can act as a switch that is turned on and off periodically by applying the signal from said oscillator 33 to its gate. The source of MOSFET Q31 is connected to ground. The drain of the transistor is connected to a fixed power voltage through coil L31 and to the output end of dc/dc converter 5' through diode 31. The cathode of diode D31 is connected to ground through capacitor C31. The OSC controller 32 is used to control the level of the variable dc voltage generated at the output end of dc/dc converter 5' by controlling the number of the activating pulse signals, which are supplied from OSC 33 to the gate of MOSFET Q31 to activate MOSFET Q31, generated per unit time or its duty ratio. The dc/dc converter 5' shown in FIG. 4 is only one of the variable voltage sources that can be used in the present invention, and other variable voltage sources can be used as long as a supply voltage V6 is generated with an appropriate dc voltage level controlled by the adjustment signal V5.

The operation of the EL driver circuit shown in FIG. 1 will be explained with reference to the waveforms shown in FIG. 2. Although the waveforms shown in FIG. 2 are used so that the operation of the EL driver circuit shown in FIG. 1 can be better understood, the timing relationship among various waveforms is not strictly followed.

First, when the power of the EL driver circuit 1 is turned on, the oscillator circuit consisting of positive feedback path 6 and the LC serial resonant circuit comprising EL panel $C_{EL}$ and coil L1 starts its oscillating operation. A driving signal in the form of a sinusoidal wave is periodically applied to EL panel $C_{EL}$ at the resonant frequency $f=1/(2\pi \cdot SQRT(L_1C_{EL}))$ of the resonant circuit. As a result, the EL panel is lit. It is also possible to set a conventional starter in the closed loop in order to regulate the resonance operation of the resonant circuit in a reliable manner.

Figure 2:
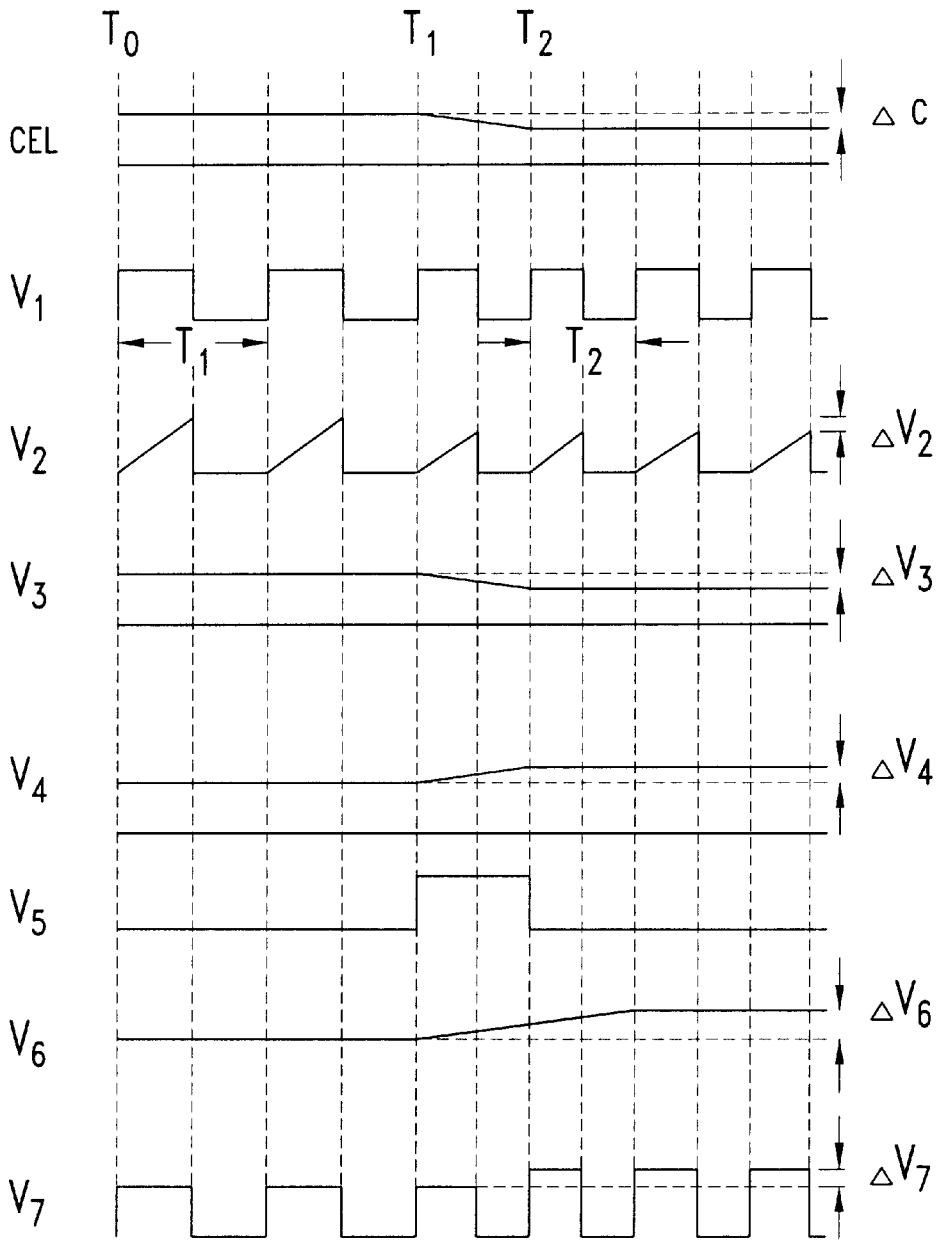
FIG. 2 is a diagram of the waveforms illustrating the operation of the EL driver circuit shown in FIG. 1.

At this time, as shown in FIG. 2, the EL panel has a capacitance $C_{EL}$ as the initial state. The push-pull driver 2 receives a supply voltage V6 having an initial voltage level V6 sent from the variable voltage source, and a pulse voltage V7 with an initial voltage level V7 almost equal to the initial voltage level of supply voltage V6 is generated at its output end. In this case, the initial period of the pulse voltage V7 is T1, and the period corresponds to the period of the resonant frequency determined by the LC serial resonant circuit comprising EL panel $C_{EL}$ and coil L1. On the other hand, the sinusoidal driving signal of EL panel $C_{EL}$ is compared with the reference voltage, and a driving signal pulse array V1 is generated from the output end of op amp OP1. The driving signal pulse array V1 has a period T1 which is identical to that of the sinusoidal driving signal.

The driving signal pulse array V1 is the integrated by integrator circuit 3. As a result, an integrated signal V2 is generated at integration node V2. The integrated signal is obtained by integrating each pulse of the driving signal pulse array V1. The pulse array is integrated according to V2=(I1/C2)×(1/2f) at integration node V2. I1 is a constant current supplied from the current source I1 to the integration node. C2 is the capacitance of capacitor C2, and f is the resonant frequency of the aforementioned LC resonant circuit. The obtained integrated signal V2 becomes a sawtooth wave. The integrated signal V2 is smoothed by a smoothing circuit comprising diode D1 and capacitor C3. The smoothed integrated signal V3 is output from integrator circuit 3.

After passing through op amp OP2, the integrated signal V3 is amplified according to the gain set in op amp OP3, and the driving voltage level detection signal V4 is output. Then, the driving voltage level detection signal V4 is input to comparator OP4, and adjustment signal V5 is output from comparator OP4. In the initial state, the adjustment signal is in the low state, and there is no need to adjust the voltage level. Therefore, supply voltage V6 having a dc voltage level set in the initial state is supplied from variable voltage source 5 to the push-pull driver 2.

The following explanation will be made under the assumption that the capacitance $C_{EL}$ decreases after EL panel $C_{EL}$ is used over a long period of time. The various waveforms in this state are shown in the right half of FIG. 2. The capacitance of EL panel $C_{EL}$ decreases from the initial value by ΔC. When the capacitance of the EL panel decreases, the resonant frequency of the LC resonant circuit increases according to the aforementioned equation of resonant frequency. Consequently, the frequency of the pulse array V1 of the driving signal of the EL panel fetched from comparator OP1 also increases. Its period T2 becomes smaller than period T1 in the initial state. This means that the light-up frequency of the EL panel increases. As a result, the drop in the luminous brightness of the EL panel caused by the decrease in the capacitance of the EL panel is recovered to some degree. However, since the period of pulse array V1 is reduced, the voltage level of integrated signal V2 generated at the integration node by integrator circuit 3 is lowered by ΔV2, compared with that in the initial state. This is because the period of pulse array V1 is reduced while the integration slope in integrator circuit 3 is constant. Consequently, when the capacitance of the EL panel decreases, the resonant frequency increases, and the light-up frequency of the EL panel is also increased. However, the voltage level of the driving signal applied to the EL panel becomes low. As a result, the luminous brightness of the EL panel cannot be fully recovered.

According to the invention, the integrated signal V2 is smoothed to generate a smoothed integrated signal V3. Its voltage level is lowered by ΔV3 compared with that in the initial state. The smoothed integrated signal V3 is then input into driving voltage level detecting circuit 4, which generates a detection signal V4 having a voltage level increased by ΔV4 corresponding to the decrease in the capacitance of the EL panel. The detection signal with its level increased by ΔV4 is input into comparator OP4. As a result, adjustment signal V5, which is a binary signal, is changed to the high level and is output from comparator OP4. When adjustment signal V5 on the high level is input, the variable voltage source raises supply voltage V6 by a desired amount of ΔV6 through the feedback circuit, and supply voltage V6 is raised during the period until adjustment signal V5 returns to the low level. Subsequently, the raised supply voltage V6 is fed to push-pull driver 2. The push-pull driver 2 applies pulse array V7 obtained by pulsing the raised supply voltage V6 to the LC resonant circuit. Since the voltage level of pulse array V7 is increased corresponding to the rise in supply voltage V6, the level of the driving signal applied to the EL panel is also increased.

In the following, a detailed example of the mechanism used for compensating the EL driving voltage level will be explained in reference to the application example shown in FIG. 1.

In the EL driver circuit shown in FIG. 1, the dc voltage level of the voltage supplied from the variable voltage source in the initial state is 80 V, and the oscillation frequency of the EL panel is assumed to be 400 Hz. In this case, as explained above, an integrated signal is generated at integration node V2 according to the equation V2=(I1/C2)×(1/2f). When I1 and C2 are assumed to be 120 μA and 100 nF, respectively, the voltage level of integrated signal V2 can be calculated as follows.

$$V2=(120\times10^{-6}/100\times10^{-9})\times(1/2\times400)=1.5\ V$$

Consequently, the smoothed integrated signal V3 becomes V3=V1−D1=1.5−0.6=0.9 V. This V3=0.9 V is then input into driving voltage level detecting circuit 4 through op amp OP2. Although the gain can be set by variable resistor VR, in this case, for the purpose of simplification, the gain is assumed to be unitary gain, and it is assumed that VR=R5=R6=R. Consequently, the following equation is obtained. V4=2·VREF−(V3+$V_{R4}$). Here, $V_{R4}$ is the voltage set by the tap position of resistor R4.

If it is assumed that R8=91 KΩ and R9=3 KΩ, when the supply voltage V6 is 80 V, voltage $V_{R8\text{-}R9}$ becomes $V_{R8\text{-}R9}$=80×(3K/(91K+3K))=2.55 V. Consequently, if V4 is set to be the same as $V_{R8\text{-}R9}$, that is, 2.55 V, a supply voltage of 80 V can be obtained as the output of the variable voltage source.

Also, $V_{R4}$ can be obtained as $V_{R4}$=2 VREF−V4−V3=2×2.55−2.55−0.0=1.65 V from the aforementioned equation. Consequently, if $V_{R4}$ is set to be 1.65 V, the voltage level of the supply voltage V6 output from the variable voltage source becomes 80 V.

As described above, when the voltage level of supply voltage V6 rises to 100 V as a result of the increase in the resonant frequency as the EL panel deteriorates, the resonant frequency becomes 697 Hz.

The case of dealing with a decrease in the capacitance of the EL panel caused by the changes occurring over time has been explained above. The present invention is also applicable even when the capacitance of the EL panel increases for some reason. In this case, however, since the capacitance of the EL panel increases, the resonant frequency drops, and the level of the supply voltage is lowered. In the aforementioned application example, an EL panel and a coil are connected to form a serial resonant circuit. Needless to say, the voltage level adjusting function of the present invention is applicable not only to the serial resonant circuit but also to a parallel resonant circuit.

As explained above, an EL panel and a coil are connected to each other to form a serial resonant circuit, and the serial resonant circuit is connected to a push-pull driver in a positive feedback manner to form an oscillator circuit. The EL panel can be lit efficiently because it is driven by a driving signal in the form of a sinusoidal wave that is substantially free of noise. Also, compared with the case using a parallel resonant circuit, when a serial resonant circuit is used, the size of the coil, especially the core, can be reduced. Consequently, the entire device can be miniaturized, and the cost can be lowered.

For example, when a parallel resonant circuit is used, the diameter and length of the core of the coil must be about 40 mm and 30 mm, respectively. When a serial resonant circuit is used, the diameter and length of the core of coil $L_1$ can be reduced to about 12 mm and 15 mm, respectively.

When the EL panel is lit repeatedly over a long period of time, its capacitance might change, especially drop. However, according to the second part of the present invention, the drop in the voltage level caused by the change in the capacitance of the EL panel can be corrected. Consequently, the luminous brightness of the EL panel can be maintained on a prescribed level over a long period of time, and the service life of the EL panel can be prolonged.

What is claimed is:

1. An EL driver circuit, comprising:

a push-pull driver having an output end and an input end and is coupled between a supply voltage and a first fixed voltage, an EL panel that can effectively form a capacitor, and a coil which is connected in series to the EL panel; one end of the serial connection of the EL panel and coil is coupled to the output end of the push-pull driver, while the other end is coupled to the input end of the push-pull driver in a positive feedback manner;

a voltage level detecting circuit to detect a change in a driving voltage of the EL panel based on a reference voltage and an integrated voltage of the driving voltage and to generate a detection signal for adjusting the supply voltage to the EL panel.

2. The EL driver circuit of claim 1 wherein the level of the supply voltage is variable.

3. The EL driver circuit of claim 1, wherein:

the push-pull driver comprises a pair of transistors, a first transistor and a second transistor, connected in a push-pull state between the supply voltage and the first fixed voltage; the common connection point of the first and second transistors is connected to the output end of the push-pull driver and the input end of the push-pull driver is connected to at least one control terminal of the first and second transistors.

4. The EL driver circuit of claim 3 wherein the first and second transistors are formed from one of either MOSFET and bipolar transistors.

5. The EL driver circuit of claims 1, further comprising an inverter set on the path used for the positive feedback connection.

6. An EL driver circuit comprising:

a push-pull driver coupled between a supply voltage and a first fixed voltage and configured to output the supply voltage in the form of a rectangular wave;

a coil coupled to an EL panel to constitute a resonant circuit, and which is connected in a loop formed by closing the push-pull driver and the resonant circuit;

an integrator circuit configured to integrate the driving voltage of the EL panel and generate an integrated voltage;

a driving voltage level detecting circuit configured to detect the change in the level of the driving voltage of the EL panel based on the first reference voltage and the integrated voltage obtained from the integrator circuit;

a supply voltage level adjusting circuit configured to generate an adjustment signal to adjust the level of the supply voltage supplied to the push-pull driver corresponding to a detection signal sent from the driving voltage level detecting circuit; and a variable voltage source configured to supply an adjusted supply voltage to the push-pull driver corresponding to the adjustment signal.

7. The EL driver circuit of claim 6 wherein the push-pull driver comprises a first comparator configured to compare an ac driving signal of the EL panel with a second reference voltage and change it to a pulse array, which is supplied to the integrator circuit.

8. The EL driver circuit of claim 7 wherein the integrator circuit includes a gate to which the pulse array is applied, a MOSFET having a source and a drain that are coupled to an integration node and the first fixed voltage, respectively, a current source coupled between the second fixed voltage and the integration node, and a first capacitor coupled between the integration node and the first fixed voltage.

9. The EL driver circuit of claim 8 wherein the integrator circuit includes a diode, which connects the integration node to an anode, and a second capacitor coupled between a cathode of the diode and the first fixed voltage.

10. The EL driver circuit of claim 6 wherein the driving voltage level detecting circuit has a first input end, to which the integrated signal is input, a second input end, to which a third reference voltage is applied, and an op amp having an output end and configured to output the detection signal.

11. The EL driver circuit of claim 10 wherein the gain of the op amp can be set at a prescribed level.

12. The EL driver circuit of claim 6 wherein the supply voltage level adjusting circuit has a first input end, to which the aforementioned detection signal is applied, a second input end, to which a voltage obtained by dividing the aforementioned supply voltage and the first fixed voltage at a prescribed ratio is applied, and a comparator configured to output the adjustment signal based on comparison between the detection signal and the divided voltage.

13. The EL driver circuit of claim 6 wherein the aforementioned variable voltage source is a dc/dc converter.

14. The EL driver circuit of claim 6 wherein the coil is connected in series to the EL panel.

15. A driver circuit for a display panel, the display panel having first and second terminals, the driver circuit comprising:

a coil having a first terminal coupled to the first terminal on the display panel, and a second terminal;

a driver having a first voltage source terminal coupled to a voltage source, an output terminal coupled to the second terminal on the coil, and a feedback terminal in communication with the second terminal of the display panel;

an integrator circuit having an input terminal coupled to the feedback terminal of the push-pull driver, and an output terminal;

a voltage level detecting circuit having an input terminal coupled to the output terminal of the integrator circuit, and an output terminal;

a supply voltage level adjusting circuit having an input terminal coupled to the output terminal of the voltage level detecting circuit, and an output terminal; and a variable voltage source circuit having an input terminal coupled to the output terminal of the supply voltage level adjusting circuit, and an output terminal coupled to the first voltage source terminal on the driver.

16. The driver circuit of claim 15 wherein the driver comprises a second voltage source terminal coupled to a fixed voltage source, and a pair of N-MOS transistors connected between the first and second voltage source terminals and configured to output a square wave supply voltage to the output terminal in response to a DC supply voltage and a sinusoidal driving signal at the feedback terminal.

17. The driver circuit of claim 16 wherein the feedback terminal in the driver is connected to at least one control terminal of the pair of N-MOS transistors.

18. The driver circuit of claim 17, further comprising a filter circuit interposed between the second terminal of the display panel and the feedback terminal of the driver.

19. The driver circuit of claim 18 wherein the filter circuit comprises a low pass filter in series with an amplifier and an inverter.

20. The driver circuit of claim 15 wherein the driver comprises a P-MOS transistor and an N-MOS transistor having a common node between the P-MOS transistor source and the N-MOS transistor drain that is coupled to the output terminal, a common gate node coupled to the feedback terminal, and a drain of the P-MOS transistor coupled to the first voltage source terminal.

21. The driver circuit of claim 15 wherein the driver comprises a PNP bipolar transistor and an NPN bipolar transistor having a common node between an emitter terminal of the NPN bipolar transistor and the collector of the PNP bipolar transistor and coupled to the output terminal, a common base node coupled to the feedback terminal, a collector of the NPN bipolar transistor coupled to the first voltage source terminal, a first current source coupled between the first voltage source terminal and the base of the NPN bipolar transistor, and a second current source coupled between a ground terminal and the base of the PNP bipolar transistor.

22. The driver circuit of claim 15 wherein the variable voltage source circuit comprises a variable voltage source having a fixed power voltage input terminal coupled to a fixed voltage supply, an output terminal coupled to the output terminal of the variable voltage source circuit; and a comparator comprising a single-ended differential operational amplifier having a positive terminal coupled to the variable voltage source circuit input terminal, a negative terminal coupled to the output terminal of the variable voltage source circuit, and an output coupled to a control input terminal on the variable voltage source, the variable voltage source configured to vary a supply voltage at the output terminal for the driver in response to the comparator output.

23. A method for driving a display panel, comprising:

applying a sinusoidal driving signal to the display panel via a push-pull driver that is coupled to the display panel and a coil to form a resonant circuit;

generating a driving signal pulse array that is also fed back to the push-pull driver;

integrating the driving signal pulse array to generate an integrated signal at an integrator circuit;

generating a detection signal at a driving voltage level detecting circuit and generating an adjustment signal at a supply voltage adjustment circuit from a comparison of the integrated signal to a supply voltage used to generate the sinusoidal driving signal; and applying the adjustment signal to adjust the sinusoidal driving signal.

24. The method of claim 23 wherein applying a sinusoidal driving signal comprises applying a sinusoidal driving signal through a coil at a predetermined resonant frequency.

25. The method of claim 23 wherein generating a driving signal pulse array comprises generating the driving signal pulse array in response to a comparison between the sinusoidal driving signal and a reference voltage.

26. The method of claim 23 wherein integrating the driving signal pulse array further comprises smoothing the integrated signal.

27. The method of claim 23 wherein integrating the driving signal pulse array to generate an integrated signal further comprises amplifying the integrated signal.

* * * * *